US008408330B2

(12) United States Patent
Hutin et al.

(10) Patent No.: US 8,408,330 B2
(45) Date of Patent: Apr. 2, 2013

(54) SYSTEMS AND METHODS FOR CANCELING NOISE AND/OR ECHOES IN BOREHOLE COMMUNICATION

(75) Inventors: Remi Hutin, New Ulm, TX (US); Sandra Reyes, ISSy les Moulineaux (FR); Shyam B. Mehta, Missouri City, TX (US); Jonna Flores, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 332 days.

(21) Appl. No.: 12/768,382

(22) Filed: Apr. 27, 2010

(65) Prior Publication Data

US 2010/0307828 A1 Dec. 9, 2010

Related U.S. Application Data

(60) Provisional application No. 61/173,031, filed on Apr. 27, 2009.

(51) Int. Cl.
*E21B 47/18* (2012.01)

(52) U.S. Cl. ..... 175/40

(58) Field of Classification Search ..... 175/40; 367/81, 83
See application file for complete search history.

(56) References Cited

U.S. PATENT DOCUMENTS

| | | | | |
|---|---|---|---|---|
| 3,309,656 | A | 3/1967 | Godbey | |
| 5,375,098 | A | 12/1994 | Malone et al. | |
| 6,626,253 | B2 | 9/2003 | Hahn et al. | |
| 2007/0263488 | A1 * | 11/2007 | Clark | 367/87 |
| 2008/0074948 | A1 | 3/2008 | Reckmann | |

* cited by examiner

*Primary Examiner* — Brad Harcourt
(74) *Attorney, Agent, or Firm* — Chadwick Sullivan

(57) ABSTRACT

Systems and methods cancel or compensate for an echo or noise in borehole communication. The systems and methods provide a downhole tool configured to provide borehole communication via mud pulse telemetry. The downhole tool pulses drilling fluid to generate a first pressure pulse and a second pressure pulse. The first pressure pulse moves upwardly with respect to the downhole component and is encoded with data associated a downhole measurement. A sensor is electrically connected to and in communication with the downhole tool. The first sensor is adapted to detect a characteristic of the second pressure pulse in the drilling mud. A ideal pressure pulse or a correction pressure pulse is generated by a downhole tool or a mud pulse modulator to reduce or cancel noise of the second pressure pulse.

21 Claims, 5 Drawing Sheets

SYSTEMS AND METHODS FOR CANCELING NOISE AND/OR ECHOES IN BOREHOLE COMMUNICATION

CROSS REFERENCE TO RELATED APPLICATION

This application claims the benefit of U.S. Provisional Application No. 61/173,031, entitled "System and Method for Echo Cancellation in Borehole Communication" filed Apr. 27, 2009, incorporated by reference herein.

FIELD OF THE INVENTION

The invention relates to wellbore communication systems and methods for generating and transmitting data signals between a surface of the Earth and a bottom hole assembly (hereinafter "BHA") of a drill string while drilling a borehole.

BACKGROUND OF THE INVENTION

A well or borehole is generally drilled into the ground to recover natural deposits of hydrocarbons and/or other desirable materials trapped in a geological formation in the Earth's crust. A well or borehole is typically drilled using a drill bit attached to a lower end of a drill string. The well or borehole may be drilled to penetrate subsurface geological formation in the Earth's crust which contain the trapped hydrocarbons and/or other materials, As a result, the trapped hydrocarbons and/or materials may be released and/or recovered via the well or borehole.

The BHA is located at the lower end of the drill string and may include the drill bit along with one or more sensors, control mechanisms and/or circuitry. Traditionally, the one or more sensors of the BHA may detect and/or measure one or more downhole measurements associated with one or more properties of the subsurface geological formation and/or fluid or gas which may be contained within the formation. Additionally, the one or more sensors of the BHA may detect and/or measure one or more downhole measurements associated with an orientation and/or a position of the BHA and the drill bit with respect to the subsurface geological formation, the natural deposits of hydrocarbons and/or other materials, and/or the surface of the Earth.

Drilling operations for the drill bit located at the BHA of the drill string may be controlled by one or more operators located at the Earth's surface or at an operations support center located locally or remotely with respect to the well, borehole and/or the drill string. The drill string may be rotated at a rotational rate by a rotary table, or a top drive located at the Earth's surface. The one or more operators may control the rotational rate, an amount of weight-on-bit and/or other operating parameters associated with the drilling process.

It is known that drilling mud may be pumped from the Earth's surface to the drill bit via an interior passage of the drill string. The drilling mud may cool and/or lubricate the drill bit during the drilling process by being pumped downhole via the drill string. Additionally, the drilling mud may transport one or more drill cuttings, which may be cut from the geological formations by the drill bit, uphole back to the Earth's surface. The drilling mud may have a density which may be controlled by the one or more operators to maintain hydrostatic pressure in the borehole at one or more desired levels.

To facilitate successful and desirable drilling operations for the well or borehole, the one or more operators must have access to and/or be aware of the downhole measurements made by the one or more sensors of the BHA. In order for the one or more operators to access the downhole measurements for controlling and/or steering the drill bit and/or a direction of the drill bit, a communication link must be established and/or provided between the one or more operators at the Earth's surface and the BHA of the drill string. A "downlink" is known to be a communication link extending downhole from the Earth's surface to the BHA of the drill string. Based on one or more downhole measurements collected by the one or more sensors located at the BHA of the drill string, the one or more operators may send or transmit one or more commands downhole to the BHA via the downlink. The one or more commands may include one or more instructions for the BHA which may facilitate a change in or a steering of a direction of the drilling by the drill bit.

An "uplink" is known to be a communication link uphole from the BHA of the drill string to the Earth's surface. An uplink is typically a transmission of the data and/or information associated with the one or more downhole measurements which may be detected, measured and/or collected by the one or more sensors located at the BHA. For example, it is often important for an operator to know the orientation of the BHA with respect to the geological formation. Thus, orientation data and/or measurements detected and/or collected by one or more sensors located at the BHA may be transmitted uphole from the BHA to the Earth's surface via the uplink. Additionally, an uplink communication may also be used to confirm that the one or more commands previously transmitted via the downlink were accurately understood b the BHA, the one or more sensors and/or the drill bit of the drill string.

A known method for providing a communication link (i.e., downlink and/or uplink communications) between the Earth's surface and the BHA is mud pulse telemetry. Mud pulse telemetry is a method of sending or transmitting one or more signals, either downlink or uplink communications, by creating one or more pressure and/or flow rate pulses (hereinafter "pressure pulses") in the drilling mud. The one or more pressure pulses may be detected by one or more sensors at a receiving location which may be located at, near or adjacent to the Earth's surface. For example, in a downlink communication, a change in the pressure or flow rate of drilling mud being pumped down the interior passage of the drill string may be detected by at least one sensors of the BHA. A pattern of the pulses, such as a frequency, a phase, and/or an amplitude, may be representative of the command sent or transmitted by the one or more operators located at Earth's surface. The pattern of the pressure pulses may be detected by at least one sensor of the BHA and may be interpreted such that the command may be understood by the BHA, the one or more sensors and/or the drill bit of the drill string.

Mud pulse telemetry systems are typically classified as one of two types of mud pulse telemetry systems which depend upon the type of pressure pulse generator being used, although "hybrid" mud pulse telemetry systems have also been disclosed. A first type of mud pulse telemetry systems may utilize a valving "poppet" system to generate a series of either positive or negative, and essentially discrete, pressure pulses which are digital representations of transmitted data and/or information. A second type of mud pulse telemetry system, an example of which is disclosed in U.S. Pat. No. 3,309,656, incorporated herein be reference in its entirety, utilizes a rotary valve or a "mud siren" pressure pulse generator which may repeatedly interrupt the downward flow of the drilling mud in the drill string, and thus may cause varying pressure waves or pulses to be generated in the drilling mud at a acoustic carrier frequency that is proportional to a rate of interruption. The data and/or information associated with the one or more downhole measurements which may be detected and/or collected by the one or more sensors of the BHA may be transmitted from the BHA to the Earth's surface by modulating the acoustic carrier frequency. A related design is that of the oscillating valve, as disclosed in U.S. Pat. No. 6,626,253, incorporated herein by reference in its entirety, wherein the rotor oscillates relative to stator, changing directions every 180 degrees, repeatedly interrupting the downward flow of the drilling fluid and causing varying pressure waves or pulses to be generated.

Referring now to the drawings wherein like numerals refer to like parts, FIG. 1 schematically illustrates a known drilling system 100, which may be on-shore or off-shore, in which the present systems and methods for canceling noise and/or echoes in borehole communication may be implemented. The drilling system 100 may be an on-shore drilling system having a drilling rig 10 which includes a drive mechanism 12 to provide a driving torque to a drill string 14. The lower end of the drill string 14 extends into a wellbore 30 and carries a drill bit 16 to drill an underground formation 18. During drilling operations, drilling fluid 20 is drawn from a mud pit 22 on at the Earth's surface 29 via one or more pumps 24, such as, for example, one or more reciprocating pumps. The drilling fluid 20 is circulated through a mud line 26 down through the drill string 14, through the drill bit 16, and back to the surface 29 via an annulus 28 between the drill string 14 and the wall 30 of the wellbore. Upon reaching the surface 29, the drilling fluid 20 is discharged through a line 32 into the mud pit 22 so that drill cuttings, such as, for example, rock and/or other well debris carried uphole in the drilling mud can settle to the bottom of the mud pit 22 before the drilling fluid 20 is recirculated into the drill string 14.

The drill string 14 includes a bottom hole assembly 33 (hereinafter "BHA 33") which may be located at, near or adjacent to the underground formation 18, the drill bit 16 and/or the wall 30 of the wellbore. The BHA 33 of the drill string 14 may include at least one downhole tool 34. The drilling system 100 may also include a drill collar 110, as shown in FIG. 2, which may be positioned within a portion of the wellbore during or after drilling the wellbore. It should be understood that the BHA 33 of the drill string 14 may include any number of downhole tools and/or other features as known to one of ordinary skill in the art.

The downhole tool 34 may be located and/or positioned within the drill collar 110 as shown in FIG. 2. The downhole tool 34 may contain one or a plurality of known types of telemetry, survey or measurement tools, such as, logging-while-drilling tools (hereinafter "LWD tools"), measuring-while-drilling tools (hereinafter "MWD tools"), near-bit tools, on-bit tools, and/or wireline configurable tools.

The LWD tools may include capabilities for measuring, processing, and storing information, as well as for communicating with surface equipment. Additionally, the LWD tools may include one or more of the following types of logging devices that measure characteristics associated with the formation 18 and/or the wellbore: a resistivity measuring device; a directional resistivity measuring device; a sonic measuring device; a nuclear measuring device; a nuclear magnetic resonance measuring device; a pressure measuring device; a seismic measuring device; an imaging device; a formation sampling device; a natural gamma ray device; a density and photoelectric index device; a neutron porosity device; and a borehole caliper device. It should be understood that the downhole tool 34 may be any LWD tool as known to one or ordinary skill in the skill.

In embodiments, the MWD tools may include one or more devices for measuring characteristics of the drill bit 16 and/or the drill string 14. The MWD tools may include one or more of the following types of measuring devices: a weight-on-bit measuring device; a torque measuring device; a vibration measuring device; a shock measuring device; a stick slip measuring device; a direction measuring device; an inclination measuring device; a natural gamma ray device; a directional survey device; a tool face device; a borehole pressure device; and a temperature device. The MWD tools may detect, collect and/or log data and/or information about the conditions at the drill bit 16, around the underground formation 18, at a front of the drill string 14 and/or at a distance around the drill strings 14. It should be understood that the downhole tool 34 may be any MWD tool as known to one of ordinary skill in the art.

The wireline configurable tool may be a tool commonly conveyed by wireline cable as known to one having ordinary skill in the art. For example, the wireline configurable tool may be a logging tool for sampling or measuring characteristics of the underground formation 18, such as gamma radiation measurements, nuclear measurements, density measurements, and porosity measurements. In embodiments, the downhole tool 34 may be a well completion tool for extracting reservoir fluids after completion of drilling.

The downhole tool 34 may comprise, may include or may incorporate a BHA power source (not shown in the drawings). The BHA power source may be, for example, a downhole motor, a downhole mud motor or any other power generating source as known to one of ordinary skill in the art. The BHA power source may produce and generate electrical power or electrical energy to be distributed throughout the BHA 33 and/or to power the at least one downhole tool 34.

It is known that the downhole tool 34 may be, for example, a MWD tool which may be incorporated into the drill string 14 and/or the near the drill bit 16 for acquisition and/or transmission of downhole measurements, data and/or information. The MWD tool 34 may include an electronic sensor package 36 and a mudflow wellbore telemetry device 38 (hereinafter "telemetry device 38") for mud pulse telemetry. The telemetry device 38 may selectively block the passage of the drilling fluid 20 through the drill string 14 to cause pressure pulses or changes in the mud line 26 at the Earth's surface. In other words, the telemetry device 38 may be utilized to modulate pressure pulses in the drilling fluid 20 to transmit downhole measurements, data and/or information from the sensor package 36 to the Earth's surface 29. Modulated changes in the pressure of the drilling fluid 20 may be detected by a pressure transducer 40 and a pump piston sensor 42, both of which may be coupled to a surface system processor (not shown in figures). The surface system processor may interpret the modulated changes in the pressure of the drilling fluid 20 to reconstruct the measurements, data and/or information collected and sent by the sensor package 36. The modulation and demodulation of a pressure wave are described in detail in commonly assigned U.S. Pat. No. 5,375,098, which is incorporated by reference herein in its entirety.

The surface system processor may be implemented using any desired combination of hardware and/or software. For example, a personal computer platform, workstation platform, etc. may store on a computer readable medium, for example, a magnetic or optical hard disk and/or random access memory and execute one or more software routines, programs, machine readable code and/or instructions to perform the operations described herein. Additionally or alternatively, the surface system processor may utilize dedicated hardware or logic such as, for example, application specific integrated circuits, configured programmable logic controllers, discrete logic, analog circuitry and/or passive electrical components to perform the functions or operations described herein.

Still further, the surface system processor may be positioned relatively proximate and/or adjacent to the drilling rig 10. In other words, the surface system processor may be substantially co-located with the drilling rig 10. Alternatively, a part of or the entire surface system processor may alternatively be located relatively remote with respect to the drilling rig 10. For example, the surface system processor may be operationally and/or communicatively coupled to the telemetry device 38 via any combination of one or more wireless or hardwired communication links (not shown in the drawings). Such communication links may include communications links via a packet switched network (e.g., the Internet), hardwired telephone lines, cellular communication links and/or other radio frequency based communication links which may utilize any communication protocol as known to one of ordinary skill in the art.

The BHA 33 may include one or more processors or processing units (not shown in the drawings), such as, for example, a microprocessor, and/or an application specific integrated circuit to manipulate and/or analyze downhole measurements, data and/or information collected at a downhole location rather than manipulate and/or analyze the downhole measurements, data and/or information at the surface and/or at the electronic sensor package 36 of the downhole tool 34.

Noise and echo cancellation techniques are traditionally applied at the receiving end of the drilling system 100, such as, for example, at the Earth's surface 29. For example, U.S. Patent Publication No. 2008/0074948, which is incorporated by reference herein in its entirety, describes noise cancellation techniques for detection and downhole compensation for noise that arises as a result of drilling operations. However, known noise cancellation techniques do not adequately cancel noise and/or echoes introduced into drilling fluid 20 which may be moving downhole or uphole within the drill string 14.

Therefore, there is a need for canceling noise and/or echoes within drilling fluid 20 which may be applied at the transmitting end of the system located downhole from the Earth's surface and/or adjacent to the BHA 33. The present invention provides noise and echo cancellation downhole for detection and correction of unwanted signals that may arise as a result of noise and/or echoes, such as, for example, noise and/or echoes of intentional signals that may be reflected off of one or more components of the BHA 33 and/or the underground formation 18.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS

The present invention relates to wellbore communication systems and methods for generating and transmitting data signals between the Earth's surface and a BHA of a drill string while drilling a wellbore. Embodiments of the present invention may be utilized with vertical, horizontal and/or directional drilling The following terms may have a specialized meaning in the present disclosure. While the meaning of many terms may be consistent with meanings that would be attributed to the terms by a person having ordinary skill in the art, the meanings of the following terms are also specified here.

For example, in the present disclosure, "fluid communication" may mean connected in such a way that a fluid in at least one component may travel to another component. For example, a bypass line (not shown in the figures) may be in fluid communication with a standpipe (not shown in the figures) by connecting the bypass line directly to the standpipe. "Fluid communication" may also refer to situations where there may be an interposing component (not shown in the figures) disposed between components that are in fluid communication. For example, a valve, a hose, or some other piece of equipment used in production of oil and gas may be disposed between the standpipe and the bypass line. The standpipe and the bypass line may still be in fluid communication with each other so long as fluid may pass from one component, through the interposing component or additional components, to the other component.

Figure 1:
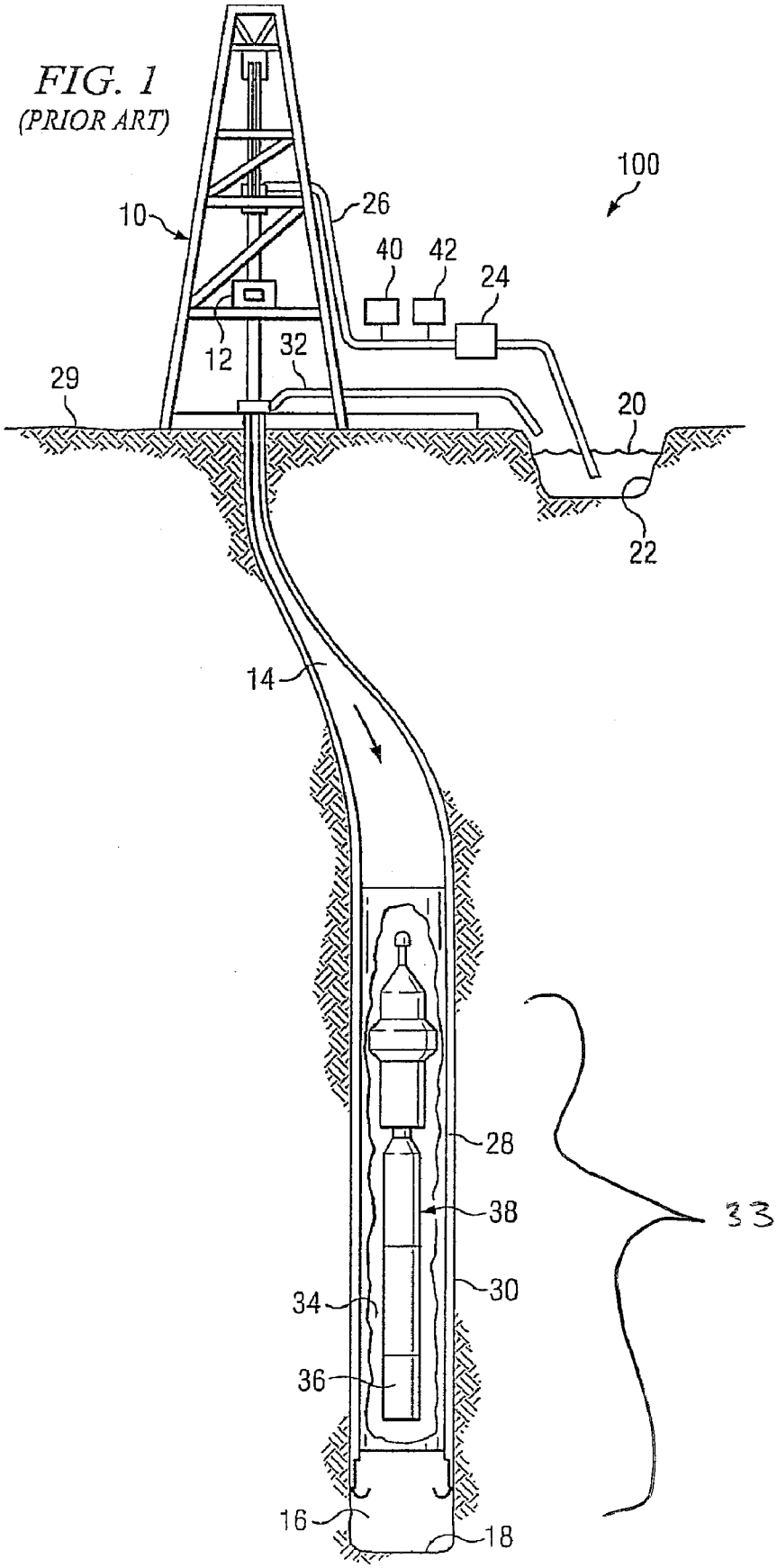
FIG. 1 (PRIOR ART)
FIG. 1 illustrates a schematic diagram, including a partially cross-sectional view, of a drilling system having wellbore telemetry device connected to a drill string and deployed from a rig into a wellbore.
Figure 2:
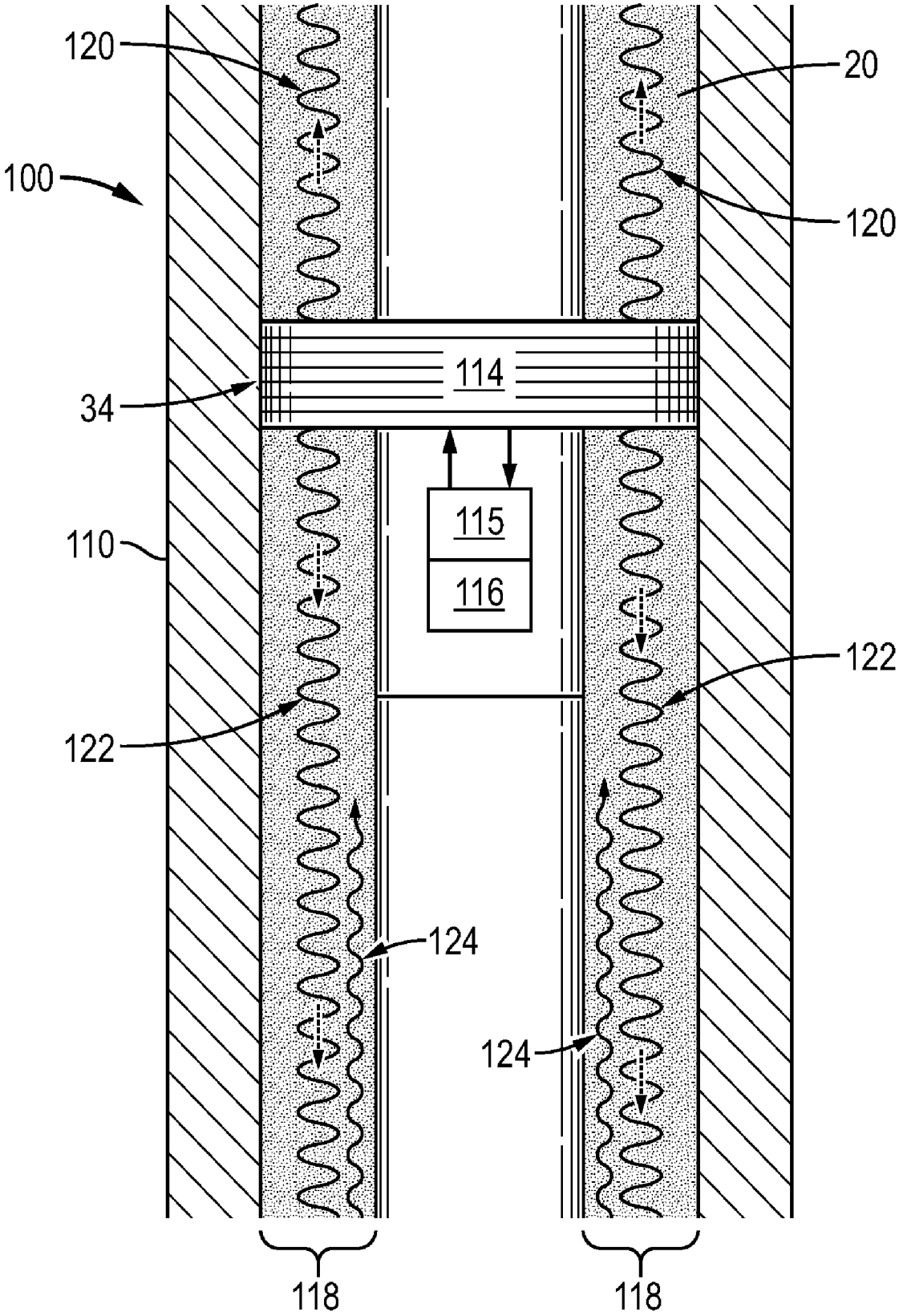
FIG. 2 illustrates a cross-sectional view of a schematic diagram of a mud pulse telemetry modulator located in a wellbore in an embodiment of the present invention.

FIG. 2 illustrates the drilling system 100 having the downhole tool 34 which may be located within the drill collar 110 within the wellbore. The downhole tool 34 may be or may include a modulator 114 which may be located within the drill collar 110. The modulator 114 may be electrically connected to, coupled to and/or in communication with the BHA power source (not shown in the drawings), a motor 115 and/or a control circuit 116. The modulator 114 may be powered and/or driven by the motor 115 and/or the BHA power source which may be controlled by the control circuit 116. Drilling fluid 20 may flow through or within an area 118 between the drill collar 110 and the downhole tool 34. The drilling fluid 20 may lubricate and/or cool the drill bit 16 of the drill string 14 during the drilling operations. The modulator 114 may utilize the drilling fluid 20 as a transmission medium for transmitting data and/or information associated with one or more downhole measurements uphole to the Earth's surface 29. In embodiments, other BHA components and/or downhole tools (not shown in the drawings) may be located downhole with respect to the downhole tool 34 and/or the modulator 114.

The modulator 114 may include a rotor and/or a stator (not shown in the drawings). When the modulator 114 is activated, the motor 115, the rotor and/or the stator may operate to impart, to pulse and/or to produce one or more upward pressure pulses 120 within the drilling fluid 20. The modulator 114 may encoded the data and/or information associated with the one or more downhole measurements within the one or more upward pressure pulses 120 within the drilling fluid 20.

The one or more downhole measurements may be detected and/or may be collected by the electronic sensor package 36 of the downhole tool 34 and/or by one or more other BHA components (not shown in the figures) within the drill string 14. The one or more upward pressure pulses 120 within the drilling fluid 20 may propagate and/or move uphole towards the Earth's surface 29. Additionally, one or more downward pressure pulses 122 may be generated by the modulator 114 when the modulator 114 generates or produces the one or more upward pressure pulses 120. As a result, the one or more downward pressure pulses 122 may propagate and/or move downhole towards the drill bit 16 of the drill string 14 and/or the underground formation 18.

The one or more downward pressure pulses 122 may reflect off one or more other BHA components (not shown in the figures) and/or the underground formation 18. As a result, the one or more downward pressure pulses may produce and/or generate one or more upward reflection pressure pulses 124 which may also be moving uphole or upwardly with respect to the Earth's surface 29. The one or more upward reflection pressure pulses 124 may produce undesirable noise and/or echo within the drilling fluid 20 moving upwardly towards the Earth's surface 29. As a result, the pressure transducer 40 and/or the piston pump sensor 42 at the Earth's surface 29 may not be able to distinguish the undesirable noise and/or echo of the one or more upward reflection pressure pulses 124 from the one or more uphole pressure pulses 120.

Figure 3:
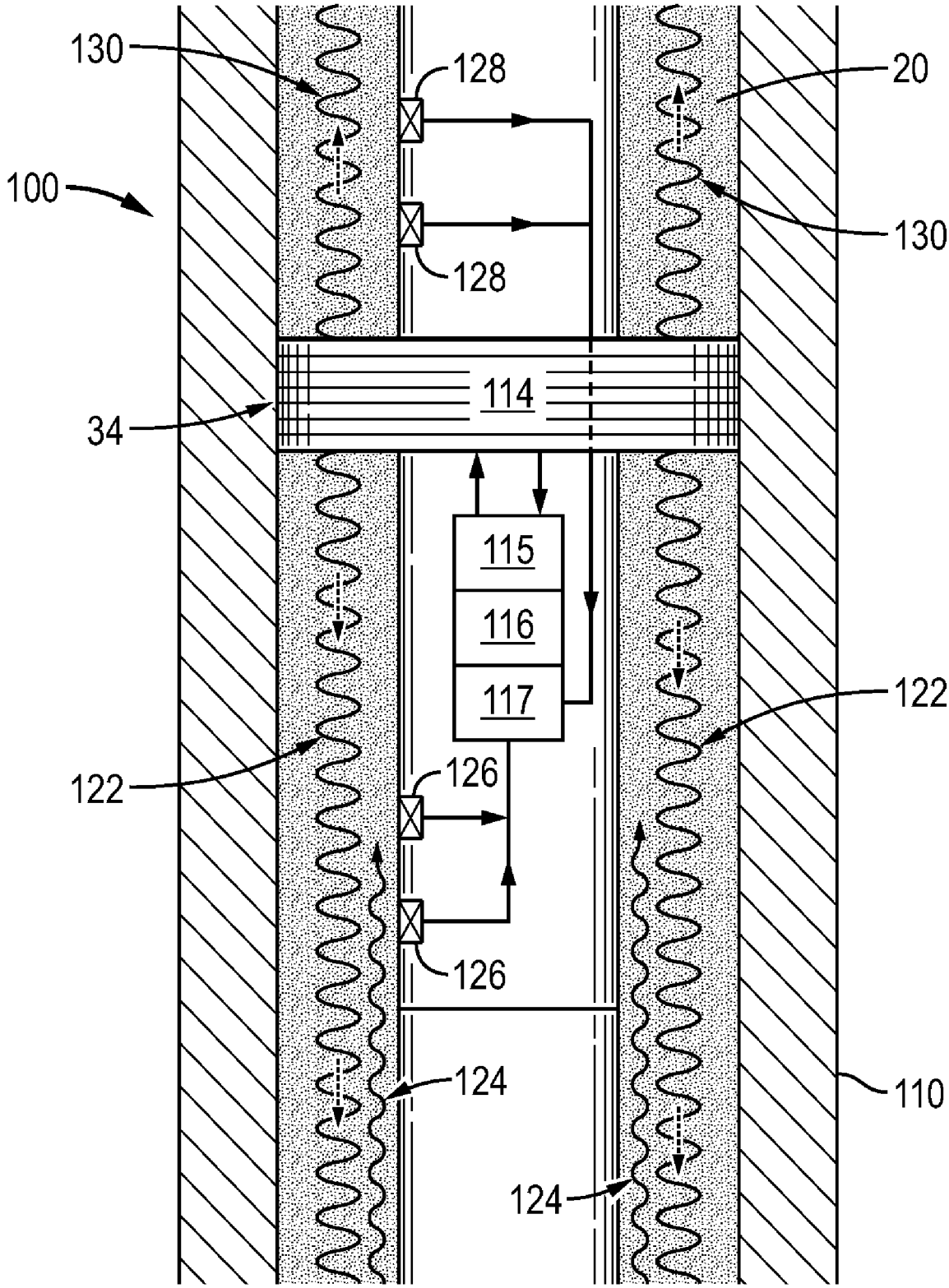
FIG. 3 illustrates a cross-sectional view of a schematic diagram of a mud pulse telemetry modulator located in a wellbore in an embodiment of the present invention.
Figure 4:
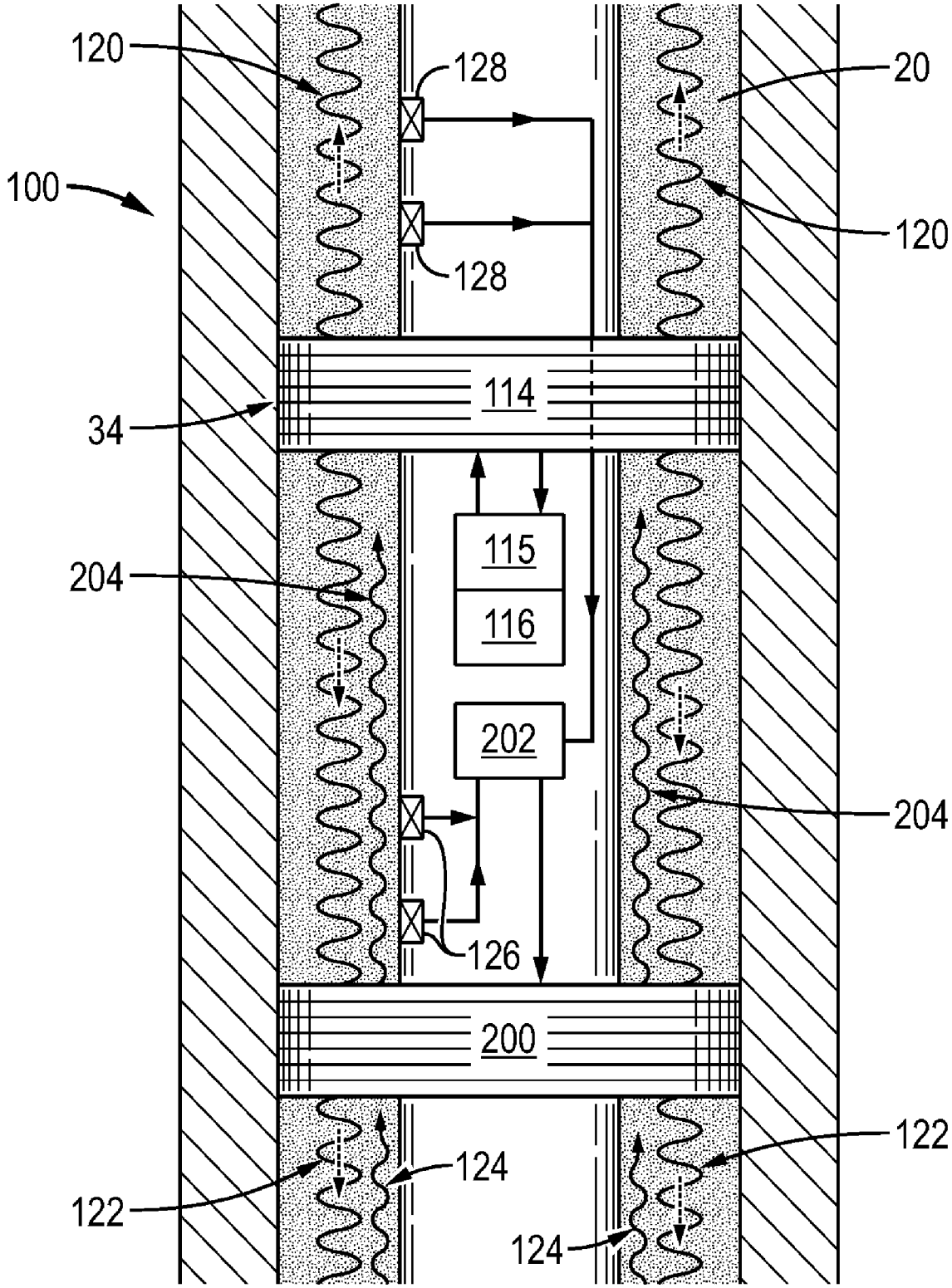
FIG. 4 illustrates a cross-sectional view of a schematic diagram of a mud pulse telemetry modulator located in a wellbore in an embodiment of the present invention.

FIGS. 3 and 4 illustrates embodiments of the drilling system 100 which may cancel and/or compensate for the undesirable noise and/or echo caused by one or more downward pressure pulses 122 and/or the one or more upward reflection pressure pulses 124. In FIG. 3, the modulator 114 may be electrically connected to, coupled to and/or in communication with the motor 115, the control circuit 116 and/or a feedback module 117. One or more first sensors 126 and/or one or more second sensors 128 may be electrically connected to, coupled to and/or in communication with the feedback module 117. As a result, the modulator 114, the motor 115 and/or the control circuit 116 may be electrically connected to coupled to and/or in communication with the one or more first sensors 126 and/or the one or more second sensors 128 via the feedback module 117.

The one or more first sensors 126 may be located downhole and/or below with respect to the modulator 114, the motor 115, the control circuit 116 and/or the feedback module 117. As a result, the feedback receiver 117 and/or the one or more first sensors 118 may be located between the modulator 114 and the drill bit 16 of the drill string 14 and/or the underground formation 18. The one or more second sensors 128 may be located uphole and/or above with respect to the modulator 114, the motor 115, the control circuit 116 and/or the feed back module 117. As a result, the one or more second sensors 128 may be located between the modulator 114 and the Earth's surface 29. Additionally, the one or more second sensors 128 may be located between the one or more first sensors 126 and the Earth's surface 29.

The one or more first sensors 126 and/or the one or more second sensors 128 may be adapted to sense and/or detect one or more properties and/or characteristics associated with the one or more pressure pulses within the drilling fluid 20. For example, the one or more first sensors 126 may sense and/or detect one or more properties associated with the one or more downward pressure pulses 122 and/or the one or more upward reflection pressure pulses 124, such as phase, frequency and/or amplitude. Moreover, the one or more second sensors 128 may sense and/or detect one or more properties and/or characteristics associated with the one or more upward pressure pulses 120 and/or the one or more upward reflection pressure pulses 124.

In embodiments, the one or more first sensors 126 may collect and/or determine feedback data which may be based on the one or more sensed and/or detected properties and/or characteristics associated with the one or more downward pressure pulses 122 and/or the one or more upward reflective pressure pulses 124. The one or more sensors 126 may transmit the feedback data to the feedback module 117. The feedback data may include, for example, amplitude data associated with amplitudes of the one or more downward pressure pulses 122 and/or the one or more upward reflective pressure pulses 124 (collectively hereinafter "pressure pulses 122, 124"). In response to the feedback data received from the one or more sensors 126, the control circuit 116 and/or the feedback module 117 may produce one or more control signals, which may be based on the feedback data and/or the amplitude data of the pressure pulses 122, 124. The modulator 114, the control circuit 116 and/or feedback module may determine a difference in the amplitudes of the pressure pulses 122, 124 based on the feedback data and/or amplitude data received from the one or more sensors 126. The modulator 114 may utilize the difference in the amplitudes of the pressure pulses 122, 124 to provide noise and/or echo cancellation of the pressure pulses 122, 124 by estimating and/or producing one or more downhole channel equalization signals and/or by equalizing the one or more upward pressure pulses 120 before transmitting the one or more upward pressure pulses 120 uphole via the drilling fluid 20.

In embodiments, the modulator 114 and/or the motor 115 may produce one or more perfect and/or ideal upward pressure pulses 130 (hereinafter "ideal pressure pulses 130") in the drilling fluid 20 based on the feedback data received from the one or more first sensors 126. The ideal pressure pulses 130 may be based on the one or more downhole channel equalization signals and/or the one or more equalized upward pressure pulses 120 generated or produced by the modulator 114. The modulator may generate and/or produce the ideal pressure pulses 130 in the drilling fluid 20 which may partially or completely cancel the noise and/or echo caused by the pressure pulses 122, 124 in the drilling fluid 20. The ideal pressure pulses 130 may propagate and/or move uphole towards the Earth's surface 29 via the drilling fluid 20. As a result, the noise and/or echo from the pressure pulses 122, 124 may be partially or completely canceled by the modulator 114.

In embodiments, the modulator 114 and/or the motor 115 may be configured and/or programmed to minimize and/or cancel the one or more downward pressure pulses 122 generated within the drilling fluid 20. As a result, the modulator 114 and/or the motor 115 may minimize and/or cancel the one or more upward reflection pressure pulses 124 generated within the drilling fluid 20 and reduce and/or cancel the noise and/or echo generated by the pressure pulses 122, 124.

Depth information associated with the one or more first sensors 126 may be provided to the modulator 114. The depth information may be based on the location(s) of the one or more first sensors 126 with respect to the modulator 114, the motor 115, the control circuit 116 and/or the feedback module 117. The modulator 114 may be preconfigured and/or preprogrammed with the depth information associated with the one or more first sensors 126. In embodiments, the modulator 114 may be accessible from the Earth's surface 29 by the one or more operators such that the depth information of the one or more first sensors 126 may be updated and/or transmitted to the modulator 114. The modulator 114 may utilize the depth information to accurately calculate and/or determine the difference in the amplitudes of the pressure pulses 122, 124 to provide noise and/or echo cancellation of the pressure pulses 122, 124 and/or to produce and/or generate the ideal pressure pulses 130.

In embodiments, the drilling system 100 may include the one or more second sensors 128 which may be located uphole with respect to the modulator 114 as shown in FIG. 3. The one or more second sensors 128 may detect and/or measure the one or more upwardly moving ideal pressure pulses 130 to determine and/or assess whether the noise and/or echo from the pressure pulses 122, 124 may be sufficiently reduced and/or cancelled by the modulator 114 and/or the motor 115. Additionally, the one or more second sensors 120 may provide ideal feedback data to the modulator 114, the motor 115 and/or the control circuit 116 via the feedback module 117. As a result, the modulator 114 and/or the motor 115 may be adjusted to reduce and/or cancel the noise and/or echo from the pressure pulses 122, 124 based on the ideal feedback data received from the one or more second sensors 128. As a result, the modulator 114 and/or the motor 115 may adjust the ideal pressure pulses which may be produced to reduce and/or cancel the noise and/or echo from the pressure pulses 122, 124.

In an embodiment, the drilling system 100 provides echo cancellation of the downward pressure pulses 122 and/or the upward reflection pressure pulses 124 as shown in FIG. 4. The modulator 114 may be located within the drilling collar 110 and may produce and/or generate one or more upward pressure pulses 120 and/or the one or more downward pressure pulses 122. The one or more first sensors 126 may be positioned at one or more locations downhole or below with respect to the modulator 114, and the one or more second sensors 128 may be positioned at one or more locations uphole or above with respect to the modulator 114. The downward pressure pulses 122 and/or the upward reflection pressure pulses 124 may be sensed and/or detected by the one or more first sensors 126.

The drilling system 100 according to FIG, 4 may include a second modulator 200 which may be electrically connected to, coupled to and/or in communication with a control circuit 202. The one or more first sensors 126 and/or the one or more second sensors 128 may be electrically connected to, coupled to and/or in communication with the control circuit 202 of the second modulator 200. As a result, the second modulator 200 may be electrically connected to, coupled to and/or in communication with the one or more first sensors 126 and/or the one or more second sensors 128 via the control circuit 202.

The one or more first sensors 126 may collect and/or determine feedback information based on the one or more sensed and/or detected downward pressure pulses 122 and/or the one or more sensed and/or detected upward reflection pressure pulses 124. The one or more first sensors 126 may transmit the feedback information based on the pressure pulses 122, 124 to the control circuit 202 of the second modulator 200. As a result, the feedback information may not alter operation of the modulator 114. The difference in, for example, amplitude of the pressure pulses 122, 124 may be determined by the second modulator 200 and/or the control circuit 202 and may be utilized to estimate channel equalization downhole and equalize the one or more upward pressure pulses 120 before transmission by the modulator 114 by generating one or more correction pressure pulses 204 at the second modulator 200 via a valve (not shown in the figures) of the modulator 200.

The one or more correction pressure pulses 204 may be substantially equal or equal to the one or more upward reflection pressure pulses 124 but may be opposite in amplitude to the one or more upward reflection pressure pulses. As a result, the one or more corrections pressure pulses 204 may cancel the noise and/or echo of the pressure pulses 122, 124. Operation of the modulator 114 may continue in due course to generate the one or more upward pressure pulses 120, and the second modulator 200 may generate the one or more correction pressure pulses 204 under a separate and independent control based on the feedback data received from the one or more first sensors 126.

In embodiments, the one or more second sensors 128 may be located above the modulator 114 and may be utilized to measure the one or more upward pressure pulses 120 generated by the modulator 114 to determine and/or assess whether the noise and/or echo of the pressure pulses 122, 124 may be sufficiently cancelled by the one or more correction pressure pulses generated by the second modulator 200. Additionally, the one or more second sensors 128 may provide feedback information to the second modulator 200 to the control the valve of the second modulator 200 for adjusting the one or more correction pressure pulses 204 generated by the second modulator 200.

The noise and/or echo cancellation technique of either of the embodiments described herein may be combined with other noise cancellation techniques to further enhance the source signal quality associated with the upward pressure pulses moving uphole from the modulator 114 towards the Earth's surface 29. Such noise cancellation techniques may include techniques that target noise generated by and/or resulting from operation of drilling equipment, such as, for example, a motor, a rotary steerable tool, the drill bit 16 of the drill string 14 and/or another component used during drilling operations as known to one of ordinary skill in the art.

Figure 5:
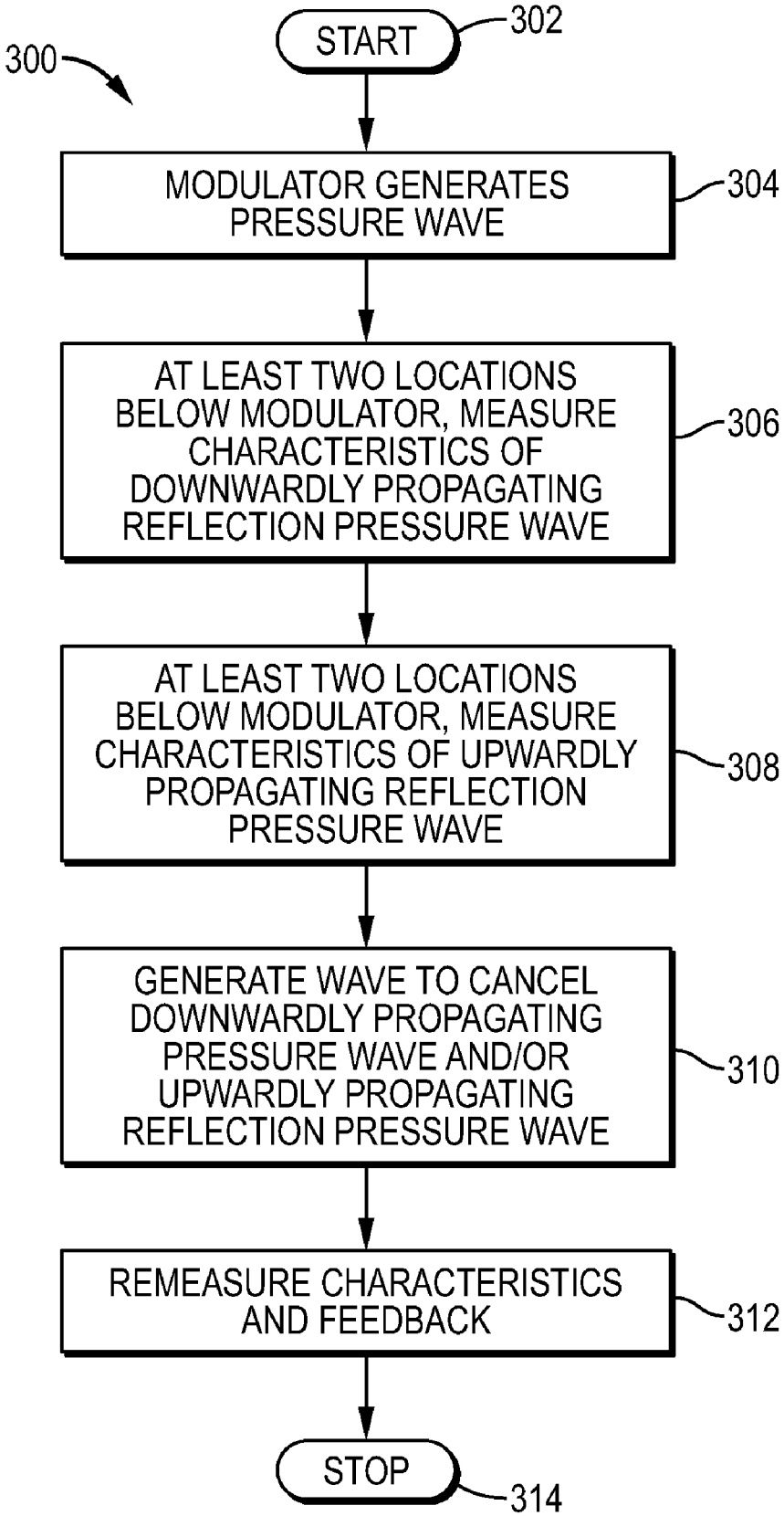
FIG. 5 illustrates a flow chart of a method for canceling one or more echoes at a source in a mud pulse telemetry system in an embodiment of the present invention.

FIG. 5 shows a flowchart for a method 300 of canceling noise and/or echo from the pressure pulses 122, 124. The noise and/or echo cancellation method may be initialized as shown at step 302. The modulator 114 may generate the one or more upward pressure pulses 120 which may form an uplink telemetry signal moving uphole from the modulator 114 to the Earth's surface 29 via the drilling fluid 20 as shown at step 304. As a result of generating the one or more upward pressure pulses 120, the modulator 114 may also generate the one or more downward pressure pulses 122.

In embodiments, at least two first sensors 126 may be positioned and/or located in at least two locations downhole with respect to the modulator 114. The at least two first sensors 126 may sense, detect and/or measure one or more characteristics of the one or more downward pressure pulses 122 as shown as step 306. Additionally, the at least two first sensors 126 may sense, detect and/or measure one or more characteristics of the one or more upward reflection pressure pulses 124 as shown at step 308. A cancellation wave may be generated to cancel noise and/or echo associated with the one or more downward pressure pulses 122 and/or upward reflection pressure pulses 124 as shown at step 310.

In embodiments, the cancellation wave may be produced by the second modulator 200 and may be in the form of the one or more corrected pressure pulses 204. Alternatively, the cancellation wave may include the one or more ideal pressure pulses 130 which may be produced by the modulator 114. Thus, the cancellation wave may be in the form of a distortion to the one or more upward pressure pulses 120 at the modulator 114 in order to result in upwardly propagating ideal pressure pulses 130 above the modulator 114. In yet another alternative embodiment, the cancellation wave may be in the form of a separate wave generated by the second modulator 200 which may cancel the one or more downward pressure pulses 122. As a result, the cancellation wave may minimize the one or more upward reflection pressure pulses propagating upwards from one or more BHA components located downhole with respect to the modulator 114.

The one or more second sensors 128 may be located uphole with respect to the modulator 114 and may re-measure the one or more characteristics of the one or more upward pressure pulses 120 and/or the ideal pressure pulses 130 to provide feedback data to modulator 114 and/or the second modulator 200 as shown at step 312. As a result, the modulator 114 and/or the second modulator may adjust the cancellation wave based on feedback data received from the one or more second sensors 128. As a result, the cancellation wave may be tuned or adjusted such that the noise and/or echo from the pressure pulses 122, 124 may be partially or completely cancelled from the one or more upward pressure pulses 120 and/or the ideal pressure pulses 130 which may propagate and/or move uphole from the modulator 114 to the Earth's surface. After the noise and echo from the pressure pulses 122, 124 are canceled by the cancellation wave, the noise and echo cancellation method may be terminated as shown at step 314.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A system for cancelling noise in borehole communication, the system comprising:

a first modulator pulsing drilling fluid to produce a first pressure pulse uphole with respect to the first modulator and a second pressure pulse downhole with respect to the first modulator;

a second modulator located downhole with respect to the first modulator; and a sensor located between the first modulator and the second modulator to measure a characteristic of the second pressure pulse, wherein the first modulator generates an ideal pressure pulse or the second modulator generates a correction pressure pulse to at least partially cancel noise generated in the drilling fluid by the second pressure pulse.

2. The system according to claim 1, wherein the second pressure pulse is moving downwardly with respect to the first modulator or is a reflection pressure pulse moving upwardly from a location downhole with respect to the first modulator.

3. The system according to claim 1, further comprising a feedback module electrically connected to and in communication with the first modulator and the sensor, wherein the feedback module is adapted to receive feedback data from the sensor, wherein the feedback data is based on the characteristic of the second pressure pulse detected by the sensor.

4. The system according to claim 3, wherein the ideal pressure pulse is based on the feedback data received from the sensor.

5. The system according to claim 1, further comprising a second sensor located uphole with respect to the first modulator, wherein the second sensor is configured to detect a characteristic associated with the first pressure pulse or the ideal pressure pulse.

6. The system according to claim 5, further comprising a feedback module electrically connected to and in communication with the first modulator and the sensor, wherein the feedback module is adapted to receive feedback data from the sensor, wherein the feedback data is based on the characteristic of the second pressure pulse detected by the sensor.

7. The system according to claim 6, wherein the ideal pressure pulse is based on the feedback data received from the sensor.

8. The system according to claim 1, wherein the correction pressure pulse is based on feedback data associated with a characteristic of the second pressure pulse and detected by the sensor.

9. A method for cancelling noise in borehole communication via mud pulse telemetry, the method comprising of:

pulsing drilling mud being pumped downhole via a drill string located within a wellbore with a first downhole modulator to generate a first pressure pulse and a second pressure pulse, wherein the first pressure pulse includes encoded data associated with a downhole measurement, and further wherein the first pressure pulse moves upwardly with respect to the first downhole modulator;

detecting a characteristic associated with a second pressure pulse produced within the drilling mud;

transmitting first feedback data from a first sensor to the first downhole modulator, wherein the first feedback data is based on the detected characteristic associated with the second pressure pulse, wherein the first sensor is located downhole with respect to the first downhole modulator; and cancelling noise generated in the drilling mud by the second pressure pulse.

10. The method according to claim 9, wherein the first downhole modulator cancels the noise in the drilling mud based on the first feedback data received from the first sensor.

11. The method according to claim 9, further comprising:

transmitting second feedback data from a second sensor to the first downhole modulator, wherein the second feedback data is based on a characteristic of the first pressure pulse detected by the second sensor.

12. The method according to claim 11, further comprising:

determining whether the noise in the drilling mud has been canceled from the first pressure pulse based one the second feedback data received from the second sensor.

13. The method according to claim 11, wherein the second pressure pulse is moving downwardly with respect to the first downhole modulator or upwardly from a location downhole with respect to the first downhole modulator.

14. The method according to claim 9, further comprising:

providing a second downhole modulator located downhole with respect to the first sensor and the first downhole modulator, wherein the second downhole modulator is electrically connected to and in communication with the first sensor.

15. The method according to claim 14, further comprising:

generating a correction pressure pulse with the second downhole modulator, wherein the correction pressure pulse cancels the noise generated in the drilling mud by the second pressure pulse, wherein the correction pressure pulse is based on the first feedback data received from the first sensor.

16. The method according to claim 9, further comprising:

generating an ideal pressure pulse based on the first feedback data received from the first sensor, wherein the ideal pressure pulse compensates for the noise within the drilling mud and moves upwardly with respect to the first downhole modulator.

17. A method for cancelling or compensating for one or more echoes in borehole communication via mud pulse telemetry, the method comprising of:

generating a first pressure pulse and a second pressure pulse in drilling mud being pumped downhole via a drill string located within a wellbore, wherein a first downhole modulator in the drill string encodes data associated with a downhole measurement into the first pressure pulse, wherein the first pressure pulse moves upwardly with respect to the first downhole modulator, wherein the second pressure pulse is moving downwardly with respect to the first downhole modulator or is a reflection pressure pulse moving upwardly from a location downhole with respect to the first downhole modulator;

measuring a characteristic associated with a second pressure pulse at two or more locations downhole with respect to the first downhole modulator, wherein an echo is generated within the drilling mud by the second pressure pulse; and generating a cancellation wave based on the measured characteristic associated with the second pressure pulse, wherein the cancellation wave cancels or compensates for the echo in the drilling mud generated by the second pressure pulse.

18. The method according to claim 17, further comprising:

transmitting first feedback data from two or more first sensors to the first downhole modulator, wherein the first feedback data is based on the detected characteristic associated with the second pressure pulse, wherein the two or more first sensors are located downhole with respect to the first downhole modulator, and further wherein the first downhole modulator generates the cancellation wave.

19. The method according to claim 17, further comprising:

transmitting second feedback data from two or more second sensors to the first downhole modulator, wherein the second feedback data is based on a characteristic of the first pressure pulse detected by the two or more second sensors.

20. The method according to claim 19, further comprising:

determining whether the echo within the drilling mud has been canceled from the first pressure pulse based one the second feedback data received from the two or more second sensors.

21. The method according to claim 17, further comprising:

providing a second downhole modulator located downhole with respect to the two or more first sensors and the first downhole modulator, wherein the second downhole modulator generates the cancellation wave.

* * * * *